US006803180B2

(12) United States Patent
Nagahara et al.

(10) Patent No.: US 6,803,180 B2
(45) Date of Patent: Oct. 12, 2004

(54) INFORMATION RECORDING MATERIAL

(75) Inventors: Tomoaki Nagahara, Minami-ashigara (JP); Gen Hayashi, Hasuda (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/419,218

(22) Filed: Apr. 21, 2003

(65) Prior Publication Data

US 2003/0228546 A1 Dec. 11, 2003

Related U.S. Application Data

(63) Continuation-in-part of application No. 09/734,654, filed on Dec. 13, 2000, now abandoned.

(30) Foreign Application Priority Data

Dec. 13, 1999 (JP) ..... 11-353252

(51) Int. Cl.[7] ..... G03C 1/85; G03C 8/00

(52) U.S. Cl. ..... 430/530; 430/505; 430/523; 430/524; 430/527; 430/529; 430/546; 430/621

(58) Field of Search ..... 430/505, 523, 430/524, 527, 529, 530, 546, 621

(56) References Cited

U.S. PATENT DOCUMENTS

| | | | |
|---|---|---|---|
| 5,137,802 | A | 8/1992 | Ueda et al. |
| 5,817,452 | A | 10/1998 | Kamosaki |
| 5,866,287 | A | 2/1999 | Christian et al. |
| 5,989,796 | A | 11/1999 | Moon |
| 6,140,038 | A | 10/2000 | Ishizuka et al. |

FOREIGN PATENT DOCUMENTS

| | | |
|---|---|---|
| JP | 62-245259 | 10/1987 |
| JP | 62-275245 | 11/1987 |
| JP | 05-197068 | 8/1993 |
| JP | 8-082905 | 3/1996 |

*Primary Examiner*—Amanda Walke
(74) *Attorney, Agent, or Firm*—Birch, Stewart, Kolasch & Birch, LLP

(57) ABSTRACT

An information recording material which contains a fluorine-containing nonionic surfactant, $1.5\times10^{-5}$ mol/m$^2$ or more of a polyvalent metal salt, and an anionic surfactant capable of forming a sparingly soluble salt in an aqueous solution with the polyvalent metal, in the outermost layer on a support on the side of an information recording layer. The information recording material is less in static charge and improved in surface deficiencies due to coating.

15 Claims, No Drawings

INFORMATION RECORDING MATERIAL

This application is a continuation-in-part of application Ser. No. 09/734,654 filed on Dec. 13, 2000, now abandoned, the entire contents of which are hereby incorporated by reference and for which priority is claimed under 35 U.S.C. §120.

FIELD OF THE INVENTION

The present invention relates to an information recording material, particularly to a silver halide color photographic light-sensitive material, especially to a heat-developable color photographic light-sensitive material, that is less in static charge, improved in stability of the coating solution and improved in coating deficiency.

BACKGROUND OF THE INVENTION

It is generally known that a fluorine-containing nonionic surfactant is used to decrease static charge of an information recording material, represented by a silver halide photographic light-sensitive material (e.g. JP-A-62-195649 ("JP-A" means unexamined published Japanese patent application)). In this case, the fluorine-containing nonionic surfactant is often added to an outermost layer. On the other hand, it is also known that, in the production of the information recording material, surface deficiencies, such as cissings, tend to occur when a plurality of hydrophilic layers are coated simultaneously onto a support conveyed at a velocity of 20 m/min or more, and various coating aids are used in the outermost layer to prevent such surface deficiencies. Also, in addition to the above compounds, matt agents, mordants, emulsions, and the like are sometimes added to the outermost layer, to provide various functions according to the purpose of the recording material to be used. If various additives are added at the same time to the outermost layer in this manner, to provide these various functions, these additives react with each other in the layer. This gives rise to the problem that surface deficiencies, which adversely affect product quality, are caused in a step of applying an information recording layer on a support, resulting in a significantly reduced product yield.

SUMMARY OF THE INVENTION

An object of the present invention is to provide an information recording material less in static charge, improved in stability of the coating solution and improved in surface deficiencies due to coating. Another object of the present invention is to provide a silver halide photographic light-sensitive material, in particular a heat-developable color photographic light sensitive material, that is less in surface deficiencies even in a production method in which two or more layers are applied simultaneously on a support convened at a velocity of 20 m/min or more.

Other and further objects, features, and advantages of the invention will appear more fully from the following description.

DETAILED DESCRIPTION OF THE INVENTION

The inventors of the present invention, having conducted earnest studies, have found that the above objects can be attained by the following means.

(1) An information recording material comprising a fluorine-containing nonionic surfactant, $1.5\times10^{-5}$ mol/m$^2$ or more of a polyvalent metal salt, and an anionic surfactant capable of forming a sparingly soluble salt in an aqueous solution with the polyvalent metal, in the outermost layer on a support on the side of an information recording layer.

(2) The information recording material according to the above (1), wherein a polyvalent metal salt and an anionic surfactant capable of forming a sparingly soluble salt with the polyvalent metal are contained in an underlayer adjacent to the outermost layer.

(3) The information recording material according to the above (1) or (2), wherein the information recording layer is a light-sensitive silver halide emulsion layer.

(4) A heat-developable color photographic light-sensitive material comprising a fluorine-containing nonionic surfactant, $1.5\times10^{-5}$ mol/m$^2$ or more of a polyvalent metal salt, and an anionic surfactant capable of forming a sparingly soluble salt in an aqueous solution with the polyvalent metal, in a surface layer on a support on the side of a light-sensitive silver halide emulsion layer.

(5) The heat-developable color photographic light-sensitive material according to the above (4), wherein a polyvalent metal salt and an anionic surfactant capable of forming a sparingly soluble salt with the polyvalent metal are contained in an underlayer adjacent to the outermost layer.

Herein, the term "a sparingly soluble salt" means a salt having a solubility to water of generally 300 mg/100 g-water (20° C.) or less, preferably 20 mg/100 g-water (20° C.) or less.

The information recording material of the present invention will be hereinafter explained in detail.

It is effective that when two or more layers are coated simultaneously onto a support conveyed at a velocity of 20 m/min or more, a layer adjacent to the outermost layer of the information recording material is made to contain a polyvalent metal salt and an anionic surfactant capable of forming a sparingly soluble salt with the polyvalent metal, in order to improve coating property and to add other functions. However, contrary to the above, this method poses the problem that cissing deficiency tends to occur. The present invention is particularly effective to solve such a technical problem in the step of coating for the information recording material. Moreover, the present invention can particularly effectively solve the problem of coating deficiency of the information recording material having such an adjacent layer as described in the above (2) and (5).

The fluorine-containing nonionic surfactant which can be used in the information recording material of the present invention is described in, for example, U.K. Patent No. 1,330,356, JP-A-49-10722, JP-A-53-84712, JP-A-54-14224, JP-A-50-113221 and JP-A-62-195649. These fluorine-containing nonionic surfactants may be used in combinations of two or more.

Specific examples of preferable fluorine-containing nonionic surfactants are shown below, but the present invention is not limited to these.

IA-1

$$C_7F_{15}COO-(CH_2CH_2O)_{10}-H$$

IA-2

$$C_{10}F_{21}COO-(CH_2CH_2O)_{10.5}-H$$

IA-3

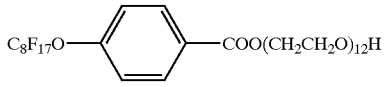

-continued

IA-4

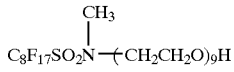

IA-5

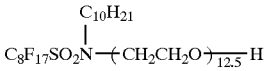

IA-6

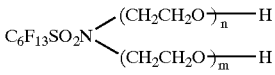

n + m = 11.5

IA-7

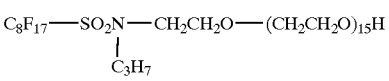

IA-8

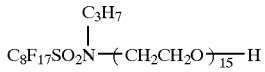

IA-9

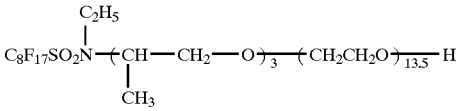

IA-10

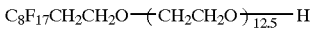

IA-11

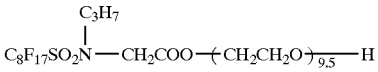

IA-12

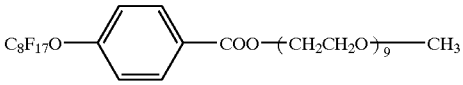

IA-13

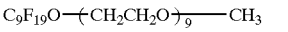

IA-14

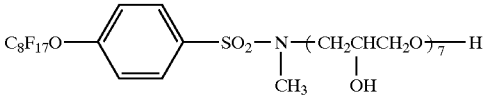

IA-15

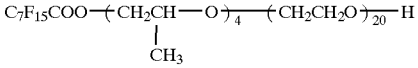

IA-16

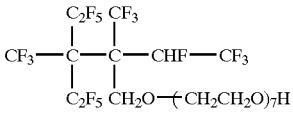

IA-17

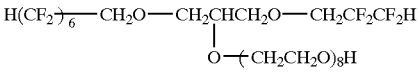

IA-18

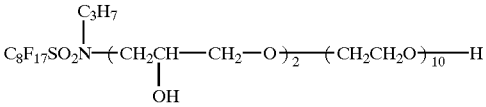

The amount of the fluorine-containing nonionic surfactant to be used in the present invention is preferably 0.0001 to 2.0 g, and particularly preferably 0.0005 to 0.1 g, per square meter of the information recording material.

Given as examples of the polyvalent metal salt for use in the outermost layer and a layer adjacent thereto may include calcium nitrate, magnesium nitrate, barium sulfate and zinc stearate. Among these salts, calcium nitrate is preferable, since it is soluble in water so that it is used with ease, as well as it is inert to other materials in the light-sensitive material.

It is necessary that the amount of the polyvalent metal salt to be used in the outermost layer be $1.5\times10^{-5}$ mol/m$^2$ or more, and the amount is preferably $2\times10^{-5}$ mol/m$^2$ to $1\times10^{-4}$ mol/m$^2$. The amount of the polyvalent metal salt to be used in the layer adjacent to the outermost layer is preferably $1\times10^{-5}$ mol/m$^2$ to 5 mol/m$^2$. When the polyvalent metal salt is calcium nitrate, the amount thereof to be used is preferably $1\times10^{-5}$ mol/m$^2$ to $1\times10^{-4}$ mol/m$^2$.

These polyvalent metal salts may be used either singly or in combination of two or more, in each of the outermost layer or the layer adjacent thereto.

As the anionic surfactant which is used in the outermost layer and the layer adjacent thereto and which is capable of forming a sparingly soluble salt with the polyvalent metal in an aqueous solution, anionic surfactants described in, for instance, JP-A-6-138623 may be used.

The anionic group of the anionic surfactant for use in the present invention is a sulfonic acid group, a carboxylic acid group, a phosphoric acid group, or the like, and the hydrophobic moiety of the anionic surfactant is a hydrocarbon, a partly or completely fluorinated hydrocarbon, or the like.

The anionic surfactant preferably used in the present invention is those represented by one of the following formulas (1) to (9). However, the anionic surfactant for use in the present invention is not limited to these compounds.

(1)

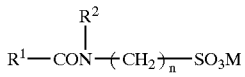

(2)

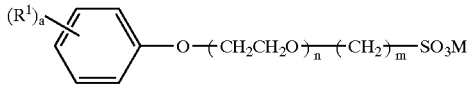

(3)

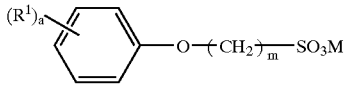

(4)

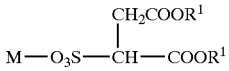

(5)

(6)

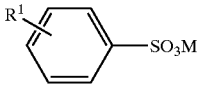

(7)

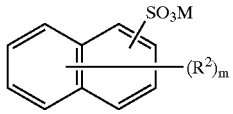

(8)

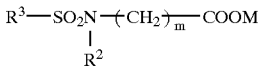

(9)

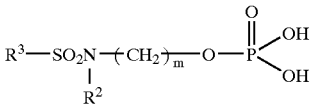

In formula (1), $R^1$ represents a saturated or unsaturated hydrocarbon group having 3 to 20 carbon atoms or a fluorine-substituted group thereof, and examples of these groups include a propyl group, heptyl group, octyl group, nonyl group, decyl group, undecyl group, dodecyl group, tridecyl group, octadecyl group, pentadecafluoroheptyl group, heptadecafluorooctyl group, heptacosafluorotridecyl group and tritriacontafluoroheptadecyl group; $R^2$ represents a hydrogen atom or a hydrocarbon group having 1 to 3 carbon atoms (e.g., a methyl group, ethyl group, n-propyl group and iso-propyl group); n is an integer from 1 to 20, among which 1 to 8 are particularly preferable; and M represents a monovalent alkali metal, and M is particularly preferably Na or K.

In formulas (2) and (3), $R^1$, M and n have the same meanings as defined in formula (1); a is 0, 1 or 2, and m is an integer from 1 to 6 among which 2 to 4 are particularly preferable.

In formulas (4), (5) and (6), $R^1$ and M have the same meanings as defined in formula (1).

In formula (7), $R^2$ and M have the same meanings as defined in formula (1) and m has the same meaning as defined in formula (2).

In formulas (8) and (9), $R^3$ represents a saturated or unsaturated hydrocarbon group which has 3 to 22 carbon atoms in which the hydrogen portion is fluorinated, and which is preferably such a hydrocarbon group having 7 to 18 carbon atoms (e.g., a pentadecafluoroheptyl group, heptadecafluorooctyl group, heptacosafluorotridecyl group or tritriacontafluoroheptadecyl group); R and M have the same meanings as defined in formula (1) and m has the same meaning as defined in formula (2).

Specific examples of the anionic surfactant which are particularly preferably used are as follows, but these are not intended to be limiting of the present invention.

I-1 $C_{11}H_{23}CONHCH_2SO_3Na$

I-2 $C_7F_{15}CONH(CH_2)_2SO_2Na$

I-3 $C_8H_{17}CON(CH_3)(CH_2)_2SO_3K$

II-1 $C_{13}H_{27}C_6H_4O(CH_2CH_2O)_3(CH_2)_3SO_3Na$

II-2 $C_{10}H_{21}C_6H_4O(CH_2CH_2O)_4(CH_2)_3SO_3Na$

II-3 $C_8H_{17}C_6H_4O(CH_2CH_2O)_3(CH_2)_4SO_3Na$

III-1 $C_8H_{17}C_6H_4O(CH_2)_3SO_3Na$

III-2 $C_9H_{19}C_6H_4O(CH_2)_2SO_3Na$

IV-1 $NaO_3S(CH_2COOCH_2CH(C_2H_5)C_4H_9)CHCOOCH_2CH(C_2H_5)C_4H_9$

V-1 $C_7H_{15}O(C_6H_4)SO_3K$

-continued

V-2 $C_{12}H_{25}O(C_6H_4)SO_3Na$

VI-1 $C_{12}H_{25}C_6H_4SO_3Na$

VII-1 $C_{10}H_6(SO_3Na)CH(CH_3)_2$

VIII-1 $C_8F_{17}SO_2NH(CH_2)_3COONa$

VIII-2 $C_{17}F_{33}SO_2NH(CH_2)_4COONa$

IX-1 $C_{13}F_{27}SO_2NH(CH_2)_3OPO(OH)_2$

These anionic surfactants may be used either singly or in combination of two or more, in each of the outermost layer or the layer adjacent thereto.

In the present invention, use can be made of the polyvalent metal salts and the anionic surfactants, each of which may be the same ones or different from each other as in the outermost layer and the layer adjacent thereto. In the present invention, it is preferable to use the same polyvalent metal salt and the same anionic surfactant, in the outermost layer and the layer adjacent thereto.

The information recording material of the present invention may be any type of information recording material which is produced by applying a hydrophilic colloidal layer on a support and which can record information. Specific examples of the information recording material include heat-sensitive recording materials, pressure-sensitive recording materials, light-sensitive materials and image-receiving materials for use in a diffusion-transfer system. Typical light-sensitive materials are silver halide photographic light-sensitive materials, including, for example, usual black-and-white silver halide light-sensitive materials (e.g., black-and-white light-sensitive materials for photographing, X-ray black-and-white light-sensitive materials, and black-and-white light-sensitive materials for printing), usual multilayer color light-sensitive materials (e.g., color papers, color reversal films, color negative films, color positive films, and color positive papers), color diffusion-transfer film units, black-and-white or color light-sensitive materials for heat development, and image-receiving materials therefor. The present invention is particularly preferably applied to color light-sensitive materials for heat development and image receiving materials therefor. These light-sensitive materials and image-receiving materials, and the method of forming a color image via heat development themselves are known. For example, those described in JP-A-11-305400 may be applied to the present invention.

According to the present invention, it is possible to obtain such unexpected effects that defects (cissings and coating In property deficiency) of the state of coated surface can be solved, as well as that electrification and the occurrence of fog can be suppressed. The present material also has fewer surface deficiencies due to the unexpectedly improved stability of the coating solution. For instance, the improved stability of the coating solution reduces the occurrence of oil droplets in the coated layers. These oil droplets cause an obstacle when the material, which has a layer obtained by applying the coating solution on another layer, is developed in order to transfer an image to an image-receiving material. Such oil droplets will prevent the transfer of the dye thereby causing white spots, and therefore causing surface deficiencies in the resulting transferred dye image.

The present invention is described in more detail with reference to the following examples, but the present invention is not limited thereto.

EXAMPLE

Example 1

Image-Receiving Material M101 having the constitution as shown in Tables 1 and 2 was made.

TABLE 1

Constitution of Image-Receiving Material M101

| Number of layer | Additive | Coated amount ($mg/m^2$) |
|---|---|---|
| Sixth layer | Water-soluble polymer(1) | 130 |
| | Water-soluble polymer(2) | 35 |
| | Water-soluble polymer(3) | 45 |
| | Potassium nitrate | 20 |
| | Anionic surfactant(1) | 6 |
| | Anionic surfactant(2) | 6 |
| | Amphoteric surfactant(1) | 50 |
| | Stain-preventing agent(1) | 7 |
| | Stain-preventing agent(2) | 12 |
| | Matt agent(1) | 7 |
| Fifth layer | Acid-processed gelatin | 170 |
| | Water-soluble polymer(5) | 35 |
| | Anionic surfactant(3) | 6 |
| | Matt agent(2) | 140 |
| | Hardener(1) | 60 |
| Forth layer | Mordant(1) | 1850 |
| | Water-soluble polymer(2) | 260 |
| | Water-soluble polymer(4) | 1400 |
| | Dispersion of latex(1) | 600 |
| | Anionic surfactant(3) | 25 |
| | Nonionic surfactant(1) | 18 |
| | Guanidine picolinate | 2550 |
| | Sodium quinolinate | 350 |
| Third layer | Gelatin | 370 |
| | Mordant(1) | 300 |
| | Anionic surfactant(3) | 12 |
| Second layer | Gelatin | 700 |
| | Mordant(1) | 290 |
| | Water-soluble polymer(1) | 55 |
| | Anionic surfactant(3) | 13 |
| | Anionic surfactant(4) | 2 |
| | High-boiling organic solvent (1) | 175 |
| | Brightening agent(1) | 2 |
| | Stain-preventing agent(3) | 8 |
| | Guanidine picolinate | 360 |
| | Potassium quinolinate | 45 |
| First layer | Acid-processed gelatin | 290 |
| | Anionic surfactant(1) | 16 |
| | Sodium metaborate | 45 |
| | Matt agent(3) | 274 |
| | Hardener(1) | 310 |
| Base(1) Polyethylene-Laminated Paper Support (thickness 215 $\mu$m) | | |

The coated amount of the dispersion of latex is in terms of the coated amount of the solid content of latex.

TABLE 2

Constitution of Support Base (1)

| Name of layer | Composition | Film thickness ($\mu$m) |
|---|---|---|
| Surface undercoat layer | Gelatin | 0.1 |

TABLE 2-continued

Constitution of Support Base (1)

| Name of layer | Composition | Film thickness ($\mu$m) |
|---|---|---|
| Surface PE layer (Glossy) | Low-density polyethylene (Density 0.923): 90.2 parts<br>Surface-processed titanium oxide: 9.8 parts<br>Ultramarine: 0.001 parts | 36.0 |
| Pulp layer | Fine quality paper (LBKP/NBSP = 6/4, Density 1.053) | 152.0 |
| Back-surface PE layer (Matte) | High-density polyethylene (Density 0.955) | 27.0 |
| Back-surface undercoat layer | Styrene/2-ethylhexyl acrylate copolymer<br>Colloidal silica<br>Polystyrenesulfonic acid sodium salt | 0.1 |
| | | 215.2 |

Anionic surfactant (1)

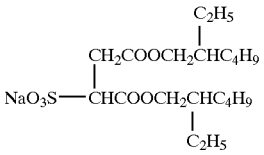

Anionic surfactant (2)

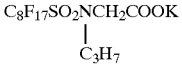

Anionic surfactant (3)

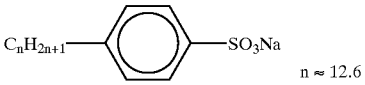

Anionic surfactant (4)

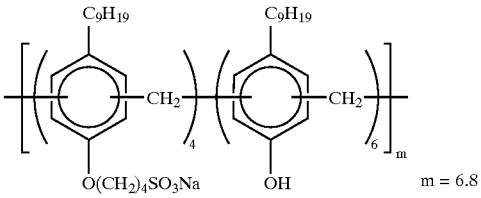

Nonionic surfactant (1)

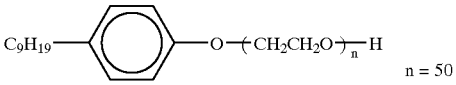

Amphoteric surfactant (1)

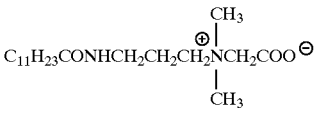

-continued

Brightening agent (1)

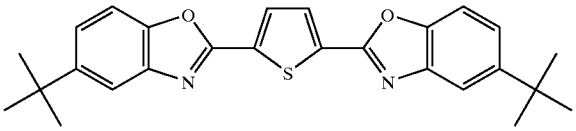

Mordant (1)

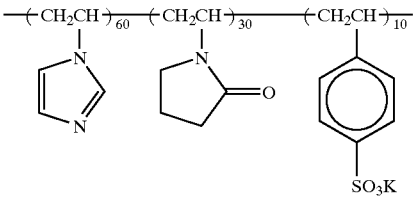

Stain-preventing agent (1)

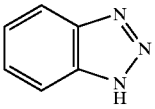

Stain-preventing agent (2)

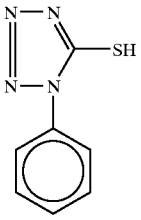

Stain-preventing agent (3)

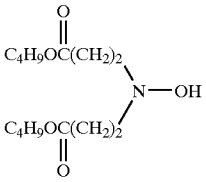

High-boiling organic solvent (1)
$C_{24}H_{44}Cl_6$
EMPARA 40 (trade name: manufactured by Ajinomoto K. K.)
Water-soluble polymer (1)
Sumikagel L5-H (trade name: manufactured by Sumitomo Kagaku Co.)
Water-soluble polymer (2)
Dextran (molecular weight 70,000)
Water-soluble polymer (3)
κ (kappa)—Carrageenan
(trade name: manufactured by Taito Co.)
Water-soluble polymer (4)
MP polymer MP-102
(trade name: manufactured by Kuraray Co.)
Water-soluble polymer (5)
Acryl-modified copolymer of polyvinyl alcohol
(modification degree: 17%)
Dispersion of latex (1)
LX-438 (trade name: manufactured by Nippon Zeon Co.)

-continued

Matt agent (1)
SYLOID79
(trade name: manufactured by Fuji Davisson Kagaku Co.)
Matt agent (2)
PMMA grains
(average grain diameter 3 μm)
Matt agent (3)
PMMA grains
(average grain diameter 4 μm)
Hardener (1)

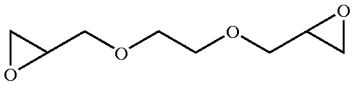

Hereinafter, the method of producing a heat-developable color light-sensitive material will be explained.

A method of making each light-sensitive silver halide emulsion will be explained.

Light-Sensitive Silver Halide Emulsion (1) (an Emulsion for a Fifth Layer (680-nm Light-Sensitive Layer)

A solution (II) having the composition shown in Table 4 was added to an aqueous solution, which was sufficiently stirred and had the composition shown in Table 3, over 9 minutes and 10 seconds; and a solution (I) was added over 9 minutes, after 10 seconds from the start of the addition of the solution (II). Further, a solution (III) having the composition shown in Table 4 was added over 33 minutes, after 5 minutes from the completion of the addition of the solution (I); and a solution (IV) was added over 34 minutes, in which the addition of the solutions (III) and (IV) was started at the same time.

TABLE 3

| Composition | |
|---|---|
| $H_2O$ | 620 ml |
| Lime-processed gelatin | 20 g |
| KBr | 0.3 g |
| NaCl | 2 g |
| Silver halide solvent (1) | 0.030 g |
| Sulfuric acid (1N) | 15.5 ml |
| Temperature | 50° C. |

TABLE 4

| | Solution (I) | Solution (II) | Solution (III) | Solution (IV) |
|---|---|---|---|---|
| $AgNO_3$ | 30.0 g | — | 70.0 g | — |
| KBr | — | 13.65 g | — | 44.1 g |
| NaCl | — | 3.60 g | — | 2.42 g |
| $K_2IrCl_6$ | — | — | — | 0.031 mg |
| Total volume | water to make 126 ml | water to make 132 ml | water to make 254 ml | water to make 252 ml |

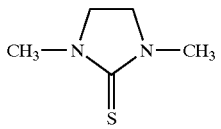

Silver halide solvent (1)

After 15 min of the start of the addition of Solution (III), 135 ml of an aqueous solution containing 0.473 g of Sensitizing Dye (1) was added over 19 min.

After washing with water and desalting (that was carried out using Settling (Precipitating) Agent a, at a pH of 3.6) in a usual manner, 22 g of lime-processed ossein gelatin, 0.30 g of NaCl, and a proper quantity of NaOH were added, and after adjusting the pH and pAg to 6.0 and 7.9 respectively, the chemical sensitization was carried out at 60° C. For chemical sensitization, the compounds shown in Table 5 were added in order of description starting from the above. The yield of the resulting emulsion was 675 g. The emulsion was a monodispersion cubic silver chlorobromide emulsion of which the coefficient of variation was 10.2% and the average particle size was 0.25 μm. Also, this finished emulsion had a pH of 6.15 (40° C.) and a viscosity of 5.4 cP (40° C.)

Sensitizing dye ①

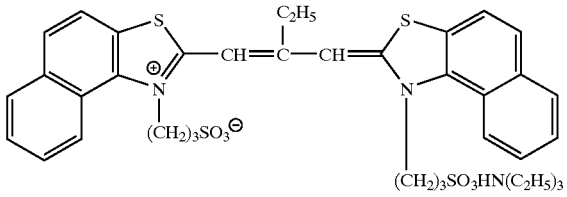

TABLE 5

| Chemicals used in chemical sensitization | Added amount |
|---|---|
| 4-hydroxy-6-methyl-1,3,3a,7-tetrazaindene | 0.15 g |
| Sodium thiosulfate | 6 mg |
| 4-hydroxy-6-methyl-1,3,3a,7-tetrazaindene | 0.15 g |
| Antifoggant② | 0.03 g |
| Antifoggant① | 0.09 g |
| Antiseptic① | 0.07 g |
| Antiseptic② | 3.13 g |

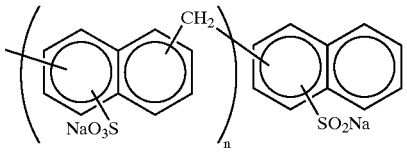

Precipitating agent a.

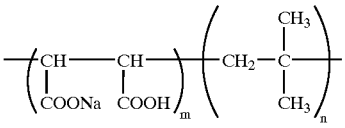

Precipitating agent b.

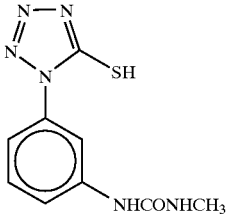

Antifoggant ①

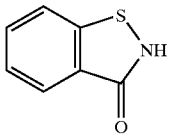

Antiseptic ①

-continued

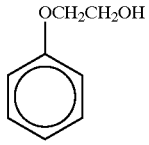

Antiseptic ②

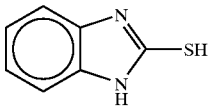

Antifoggant ②

Light-Sensitive Silver Halide Emulsion (2) (an Emulsion for a Third Layer (750-nm Light-Sensitive Layer)

A solution (II) having the composition shown in Table 7 was added to an aqueous solution, which was sufficiently stirred and had the composition shown in Table 6, over 18 minutes; and a solution (I) was added over 17 minutes and 50 seconds, after 10 seconds from the start of the addition of the solution (II). A solution (III) having the composition shown in Table 7 was added over 24 minutes, after 5 minutes from the completion of the addition of the solution (I), and a solution (IV) was added over 24 minutes and 30 seconds, in which the addition of the solutions (III) and (IV) was started at the same time.

TABLE 6

| Composition | |
|---|---|
| $H_2O$ | 620 ml |
| Lime-processed gelatin | 20 g |
| KBr | 0.3 g |
| NaCl | 1.98 g |
| Silver halide solvent① | 0.030 g |
| Sulfuric acid (1N) | 16 ml |
| Temperature | 45° C. |

TABLE 7

| | Solution (I) | Solution (II) | Solution (III) | Solution (IV) |
|---|---|---|---|---|
| $AgNO_3$ | 30.0 g | — | 70.0 g | — |
| KBr | — | 13.65 g | — | 44.1 g |
| NaCl | — | 3.59 g | — | 2.39 g |
| $K_4[Fe(CN)_6].H_2O$ | — | — | — | 65 mg |
| $K_2IrCl_6$ | — | — | — | 0.040 mg |
| Total volume | water to make 180 ml | water to make 180 ml | water to make 247 ml | water to make 250 ml |

After washing with water and desalting (that was carried out using the above Settling Agent b at a pH of 3.9) in a usual manner, 22 g of lime-processed ossein gelatin from which calcium had been removed (the calcium content: 150 ppm or less) was added, re-dispersing was made at 40° C., 0.39 g of 4-hydroxy-6-methyl-1,3,3a,7-tetrazaindene was added, and the pH and pAg were adjusted to 5.9 and 7.8, respectively. Thereafter the chemical sensitization was carried out at 60° C. For chemical sensitization, the compounds shown in Table 8 were added in order of description from the above. At the end of the chemical sensitization, Sensitizing Dye ② in the form of a methanol solution (the solution having the composition shown in Table 9) was added. After the chemical sensitization, the temperature was lowered to 50° C. and then 200 g of a gelatin dispersion of the later-described Stabilizer ① was added, followed by stirring well and keeping in a case. The yield of the thus-obtained emulsion was 938 g, and the emulsion was a monodispersed cubic silver chlorobromide emulsion having a deviation coefficient of 12.6% and an average grain size of 0.25 μm.

TABLE 8

| Chemicals used in chemical sensitization | Added amount |
|---|---|
| Triethylthiourea | 3.1 mg |
| Nucleic acid decomposition product | 0.39 g |
| 4-hydroxy-6-methyl-1,3,3a,7-tetrazaindene | 0.29 g |
| NaCl | 0.15 g |
| KI | 0.12 g |
| Antifoggant(2) | 0.08 g |
| Antiseptic(1) | 0.07 g |

TABLE 9

| Composition of dye solution | Added amount |
|---|---|
| Sensitizing dye(2) | 0.18 g |
| Methanol | 18.7 ml |

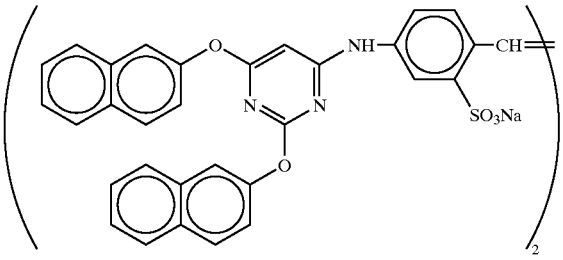

Stabilizer (1)

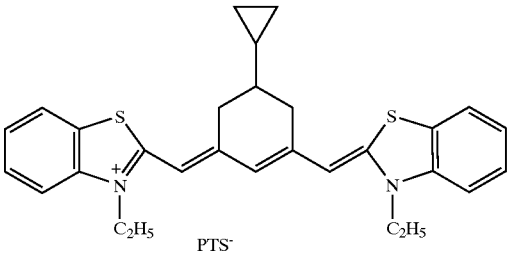

Sensitizing dye (2)

PTS: Paratoluene sulfonic acid

Light-Sensitive Silver Halide Emulsion (3) (an Emulsion for a First Layer (810-nm Light-Sensitive Layer)

A solution (II) having the composition shown in Table 11 was added to an aqueous solution, which was sufficiently stirred and had the composition shown in Table 10, over 30 minutes and 10 seconds; and a solution (I) was added over 30 minutes, after 10 seconds from the start of the addition of the solution (II). A solution (III) having the composition shown in Table 11 was added over 24 minutes, after 5 minutes from the completion of the addition of the solution (I), and a solution (IV) was added over 23 minutes and 30 seconds, in which the addition of the solutions (III) and (IV) was started at the same time.

TABLE 10

| Composition | |
|---|---|
| $H_2O$ | 620 ml |
| Lime-processed gelatin | 20 g |
| KBr | 0.3 g |
| NaCl | 2 g |
| Silver halide solvent(1) | 0.030 g |
| Sulfuric acid (1N) | 15.5 ml |
| Temperature | 50° C. |

TABLE 11

| | Solution (I) | Solution (II) | Solution (III) | Solution (IV) |
|---|---|---|---|---|
| $AgNO_3$ | 30.0 g | — | 70.0 g | — |
| KBr | — | 13.65 g | — | 44.1 g |
| NaCl | — | 3.6 g | — | 2.4 g |
| $K_2IrCl_6$ | — | — | — | 0.020 mg |
| Yellow prussiate of patash | — | — | — | 0.04 g |
| Total volume | water to make 180 ml | water to make 180 ml | water to make 248 ml | water to make 241 ml |

After washing with water and desalting (that was carried out using the Settling Agent a, at a pH of 3.7) in a usual manner, 22 g of lime-processed ossein gelatin was added, and after adjusting the pH and pAg to 7.4 and 7.8 respectively, the chemical sensitization was carried out at 60° C. For chemical sensitization, the compounds shown in Table 12 were added in order of description from the above. The yield of the resulting emulsion was 683 g. The emulsion was a monodispersion cubic silver chlorobromide emulsion of which the coefficient of variation was 9.7% and the average particle size was 0.35 μm.

TABLE 12

| Chemicals used in chemical sensitization | Added amount |
|---|---|
| 4-hydroxy-6-methyl-1,3,3a,7-tetrazaindene | 0.125 g |
| Triethylthiourea | 1.98 mg |
| 4-hydroxy-6-methyl-1,3,3a,7-tetrazaindene | 0.125 g |
| Antifoggant(2) | 0.16 g |
| Antiseptic(1) | 0.07 g |
| Antiseptic(2) | 3 g |

The preparation method of a gelatin dispersion of colloidal silver is described.

To a well-stirred aqueous solution having the composition shown in Table 13, was added a Solution having the composition shown in Table 14, over 24 min.

Thereafter, the washing with water using Settling Agent a was carried out, then 43 g of lime-processed ossein gelatin was added, and the pH was adjusted to 6.3. The average grain size of the thus-obtained grains in the dispersion was 0.02 μm and the yield was 512 g. (The dispersion was a dispersion containing silver 2% and gelatin 6.8%.)

TABLE 13

| Composition | |
|---|---|
| $H_2O$ | 620 ml |
| Dextrin | 16 g |
| NaOH(5N) | 41 ml |
| Temperature | 30° C. |

TABLE 14

| Composition | |
|---|---|
| $H_2O$ | 135 ml |
| $AgNO_3$ | 17 g |

The preparation methods of gelatin dispersions of hydrophobic additives are described.

Gelatin dispersions of a yellow dye-providing compound, a magenta dye-providing compound, or a cyan dye-providing compound whose formulation are shown in Table 15, were prepared, respectively. That is, the oil phase components were dissolved by heating to about 70° C., to form a uniform solution, and to the resultant solution, was added the aqueous phase components that had been heated to about 60° C., followed by stirring to mix and dispersing by a homogenizer for 10 min at 10,000 rpm. To the resultant dispersion, was added additional water, followed by stirring, to obtain a uniform dispersion. Further, by using an ultrafiltration module (Ultrafiltration Module ACV-3050, trade name, manufactured by Asahi Chemical Industry Co., Ltd.), the gelatin dispersion of the cyan dye-providing compound was repeatedly diluted with water and concentrated to decrease the amount of ethyl acetate so that the amount might become 1/17.6 of the amount of ethyl acetate shown in Table 15.

TABLE 15

| | | Composition of dispersion | | |
|---|---|---|---|---|
| | | Dispersion of Yellow | Dispersion of Magenta | Dispersion of Cyan |
| Oil phase | Yellow dye-providing compound ① | 9.5 g | — | — |
| | Magenta dye-providing compound ① | — | 13.6 g | — |
| | Cyan dye-providing compound ① | — | — | 15.4 g |
| | Cyan dye-providing compound ② | — | — | 1.8 g |
| | Reducing agent ① | 1.7 g | 0.2 g | 2.0 g |
| | Antifoggant ③ | 0.2 g | — | 0.2 g |
| | Antifoggant ④ | — | 0.7 g | — |
| | Surfactant ① | 1.1 g | 0.7 g | — |
| | High-boiling solvent ① | 4.7 g | — | 4.6 g |
| | High-boiling solvent ② | — | 10.2 g | 4.9 g |
| | Development accelerator ① | 0.6 g | 2.1 g | — |
| | Dye(a) | 1.1 g | — | 0.5 g |
| | Water | 0.4 ml | — | — |
| | Ethyl acetate | 10.7 ml | 25.1 ml | 53.3 ml |
| Aqueous phase | Lime-processed gelatin | 10.0 g | 10.0 g | 10.0 g |
| | Calcium nitrate | 0.1 g | 0.1 g | — |
| | Surfactant ① | — | — | 0.8 g |
| | Carboxymethyl cellulose | — | — | 0.3 g |
| | Water | 60.4 ml | 109 ml | 95.7 ml |
| | Additional water after emulsification and dispersing | 99.8 ml | 170 ml | 209 ml |
| | Antiseptic ① | 0.004 g | 0.004 g | 0.1 g |

A gelatin dispersion of Antifoggant ④ whose formulation is shown in Table 16 was prepared. That is, the oil phase components were dissolved by heating to about 60° C., to the resultant solution, was added the aqueous phase components that had been heated to about 60° C., and after stirring and mixing them, the resultant mixture was dispersed for 10 min at 10,000 rpm by a homogenizer, to obtain a uniform dispersion.

TABLE 16

| | | Composition of dispersion |
|---|---|---|
| Oil phase | Antifoggant ④ | 0.8 g |
| | Reducing agent ① | 0.1 g |
| | High-boiling solvent ② | 2.3 g |
| | High-boiling solvent ⑤ | 0.2 g |
| | Surfactant ① | 0.5 g |
| | Surfactant ④ | 0.5 g |
| | Ethyl acetate | 10.0 ml |
| Aqueous phase | Lime-processed gelatin | 10.0 g |
| | Calcium nitrate | 0.1 g |
| | Antiseptic ① | 0.004 g |
| | Water | 45.2 ml |
| | Additional water after emulsification and dispersing | 35.0 ml |

A gelatin dispersion of Magenta dye-providing compound ②, Reducing agent ②, and High-boiling solvent ① whose formulation is shown in Table 17 was prepared (Dispersions A, B). That is, the oil phase components were dissolved by heating to about 60° C., to the resultant solution, was added the aqueous phase components that had been heated to about 60° C., and after stirring and mixing them, the resultant mixture was dispersed for 10 min at 10,000 rpm by a homogenizer, to obtain a uniform dispersion.

TABLE 17

| | | Composition of dispersion |
|---|---|---|
| Oil phase | Magenta dye-providing compound ② | 0.13 g |
| | Reducing agent ② | 0.07 g |
| | High-boiling solvent ① | 9.1 g |
| | High-boiling solvent ⑤ | 0.2 g |
| | Surfactant ① | 0.5 g |

TABLE 17-continued

| | | Composition of dispersion |
|---|---|---|
| | Surfactant④ | 0.5 g |
| | Ethyl acetate | 10.0 ml |
| Aqueous phase | Lime-processed gelatin | 10.0 g |
| | Calcium nitrate | 0.1 g |
| | Antiseptic① | 0.004 g |
| | Water | 74.1 ml |
| | Additional water after emulsification and dispersing | 104.0 ml |

A gelatin dispersion of Reducing Agent ② whose formulation is shown in Table 18 was prepared. That is, the oil phase components were dissolved by heating to about 60° C., to the resultant solution, was added the aqueous phase components that had been heated to about 60° C., and after stirring and mixing them, the resultant mixture was dispersed for 10 min at 1,000 rpm by a homogenizer, to obtain a uniform dispersion. From the thus-obtained dispersion, ethyl acetate was removed off using a vacuum organic solvent removing apparatus.

TABLE 18

| | | Composition of dispersion |
|---|---|---|
| Oil phase | Reducing agent② | 7.5 g |
| | High-boiling solvent① | 4.7 g |
| | Surfactant① | 1.9 g |
| | Ethyl acetate | 14.4 ml |
| Aqueous phase | Acid-processed gelatin | 10.0 g |
| | Antiseptic① | 0.02 g |
| | Antiseptic③ | 0.04 g |
| | Sodium bisulfite | 0.1 g |
| | Water | 136.7 ml |

A dispersion of Polymer Latex(a) whose formulation is shown in Table 19 was prepared. That is, to a mixed solution of Polymer Latex (a), Surfactant ⑤, and water, whose amounts are shown in Table 19, with stirring, Anionic Surfactant ⑦ was added, over 10 min, to obtain a uniform dispersion. Further, the resulting dispersion was repeatedly diluted with water and concentrated, using a ultrafiltration module (Ultrafiltration Module: ACV-3050, trade name, manufactured by Ashahi Chemical Industry Co., Ltd.), to bring the salt concentration of the dispersion to ⅙, thereby obtaining the intended dispersion.

TABLE 19

| | Composition of dispersion |
|---|---|
| Polymer Latex a aqueous solution (solid content 13%) | 108.1 ml |
| Surfactant⑤ | 20.0 g |
| Surfactant⑦ aqueous solution(5%) | 600.0 ml |
| Water | 1232.0 ml |

A gelatin dispersion of Stabilizer ① whose formulation is shown in Table 20 was prepared. That is, the oil phase components were dissolved at room temperature, to the resultant solution, were added the aqueous phase components that had been heated to about 40° C., and after stirring and mixing them, the resultant mixture was dispersed for 10 min at 10,000 rpm by a homogenizer. To the resultant dispersion, was added additional water, followed by stirring, thereby obtaining a uniform dispersion.

TABLE 20

| | | Composition of dispersion |
|---|---|---|
| Oil phase | Stabilizer① | 4.0 g |
| | Sodium hydroxide | 0.3 g |
| | Methanol | 62.8 g |
| | High-boiling solvent④ | 0.9 g |
| Aqueous phase | Gelatin from which calcium had been removed (Ca content 100 ppm or less) | 10.0 g |
| | Antiseptic① | 0.04 g |
| | Water | 320.5 ml |

A gelatin dispersion of zinc hydroxide was prepared according to the formulation shown in Table 21. That is, after the components were mixed and dissolved together, dispersing was carried out for 30 min in a mill, using glass beads having an average particle diameter of 0.75 mm. Then the glass beads were separated and removed off, to obtain a uniform dispersion. (The zinc hydroxide having an average particle size of 0.25 μm was used.)

TABLE 21

| | Composition of dispersion |
|---|---|
| Zinc hydroxide | 15.9 g |
| Carboxymethyl cellulose | 0.7 g |
| Poly(sodium acrylate) | 0.07 g |
| Lime-processed gelatin | 4.2 g |
| Water | 100 ml |
| High-boiling solvent④ | 0.4 g |

The preparation method of a gelatin dispersion of a matt agent that was to be added to the protective layer is described.

A solution containing PMMA dissolved in methylene chloride was added, together with a small amount of a surfactant, to gelatin, and they were stirred and dispersed at high speed. Then the methylene chloride was removed off using a vacuum solvent removing apparatus, to obtain a uniform dispersion having an average particle size of 4.3 μm.

Using the above materials, Heat-Developable Color Light-Sensitive Material 101, as shown in Tables 22 and 23, was prepared. The amount to be coated referred to herein indicates the amount to be coated in the state that the solution of each layer is applied, and it does not indicate the amount to be coated of each applied layer in the state that the solution is dried. The Antispetic ④ shown below was added to in the seventh layer in an appropriate amount.

TABLE 22

Constitution of Main Materials of Heat-Developable Light-Sensitive Material 101

| Number of layer | Name of layer | Additive | Coated amount (mg/m²) |
|---|---|---|---|
| Seventh layer | Protective layer | Acid-processed gelatin | 629 |
| | | Reducing agent② | 47 |
| | | High-boiling solvent① | 30 |

TABLE 22-continued

Constitution of Main Materials of Heat-Developable Light-Sensitive Material 101

| Number of layer | Name of layer | Additive | Coated amount (mg/m$^2$) |
|---|---|---|---|
| | | Colloidal silver grains | 2 |
| | | Matt agent(PMMA resin) | 17 |
| | | Surfactant② | 0.4 |
| | | Surfactant① | 12 |
| | | Surfactant③ | 1.6 |
| | | Polymer Latex (a) | 30 |
| | | Surfactant⑥ | 19 |
| | | Surfactant⑦ | 25 |
| | | Calcium nitrate | 6.1 |
| Sixth layer | Intermediate layer | Lime-processed gelatin | 668 |
| | | Antifoggant④ | 12 |
| | | Reducing agent① | 1.5 |
| | | High-boiling solvent② | 35 |
| | | High-boiling solvent⑤ | 3.5 |
| | | Surfactant① | 72 |
| | | Surfactant② | 1.2 |
| | | Surfactant④ | 7.2 |
| | | Surfactant⑤ | 48 |
| | | Zinc hydroxide | 373 |
| | | Water-soluble polymer① | 7.2 |
| | | Calcium nitrate | 13 |
| Fifth layer | Red-light-sensitive layer | Lime-processed gelatin | 451 |
| | | Light-sensitive silver halide emulsion (1) | in terms of silver 299 |
| | | Magenta dye-providing compound① | 410 |
| | | High-boiling solvent② | 308 |
| | | Reducing agent① | 6 |
| | | Development accelerator① | 64 |
| | | Antifoggant④ | 20 |
| | | Surfactant① | 22 |
| | | Water-soluble polymer① | 8.2 |
| | | Calcium nitrate | 4.2 |
| Forth layer | Intermediate layer | Lime-processed gelatin | 669 |
| | | Antifoggant④ | 12 |
| | | Reducing agent① | 1.5 |
| | | High-boiling solvent② | 35 |
| | | High-boiling solvent⑤ | 3.5 |
| | | Surfactant① | 7.2 |
| | | Surfactant② | 1.2 |
| | | Surfactant④ | 7.2 |
| | | Surfactant⑤ | 49 |
| | | Zinc hydroxide | 374 |
| | | Water-soluble polymer① | 7.2 |
| | | Calcium nitrate | 13 |
| Third layer | The second infrared light-sensitive layer | Lime-processed gelatin | 391 |
| | | Light-sensitive silver halide emulsion(2) | in terms of silver 134 |
| | | Stabilizer① | 11.5 |
| | | Cyan dye-providing compound① | 351 |
| | | Cyan dye-providing compound② | 40 |
| | | Dye(a) | 11 |
| | | High-boiling solvent① | 105 |
| | | High-boiling solvent② | 112 |
| | | Reducing agent① | 46 |
| | | Antifoggant③ | 4.8 |
| | | Surfactant① | 12 |
| | | Carboxymethyl cellulose | 5.8 |
| | | Water-soluble polymer① | 12 |
| Second layer | Intermediate layer | Lime-processed gelatin | 526 |
| | | Magenta dye-providing compound② | 1.8 |
| | | Reducing agent② | 0.93 |
| | | High-boiling solvent① | 128 |
| | | High-boiling solvent⑤ | 3.2 |
| | | Surfactant① | 6.6 |
| | | Surfactant④ | 6.6 |
| | | Surfactant⑤ | 17 |
| | | Antifoggant⑤ | 3.4 |

TABLE 22-continued

Constitution of Main Materials of Heat-Developable Light-Sensitive Material 101

| Number of layer | Name of layer | Additive | Coated amount (mg/m$^2$) |
|---|---|---|---|
| | | Water-soluble polymer① | 26 |
| | | Calcium nitrate | 12 |
| First layer | The second infrared light-sensitive layer | Lime-processed gelatin | 629 |
| | | Light-sensitive silver halide emulsion(3) | in terms of silver 331 |
| | | Stabilizer① | 18 |
| | | Yellow dye-providing compound① | 396 |
| | | Sensitizing dye③ | 0.12 |
| | | Dye(a) | 46 |
| | | High-boiling solvent① | 198 |
| | | Reducing agent① | 71 |
| | | Development accelerator① | 25 |
| | | Antifoggant③ | 6.8 |
| | | Surfactant① | 45 |
| | | Water-soluble polymer② | 42 |
| | | Hardener① | 59 |
| Base (2) Paper support laminated with polyethylene | | | |

TABLE 23

Constitution of Support Base (2)

| Name of layer | Composition | Film thickness (μm) |
|---|---|---|
| Surface undercoat layer | Gelatin | 0.1 |
| Surface PE layer | Low-density polyethylene (Density 0.923): 89.2 parts Surface-processed titanium oxide: 10.0 parts Ultramarine: 0.8 parts | 36.0 |
| Pulp layer | Fine quality paper (LBKP/NBSP = 1/1, Density 1.080) | 64.0 |
| Back-surface PE layer | High-density polyethylene (Density 0.960) | 31.0 |
| Back-surface undercoat layer | Gelatin | 0.05 |
| | Colloidal silica | 0.05 |
| | The total of film thickness | 131.2 |

Cyan dye-providing compound ①
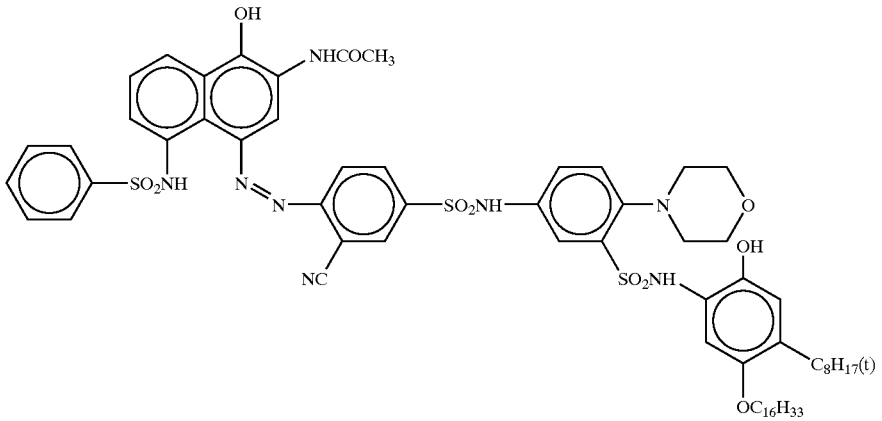
Cyan dye-providing compound ②
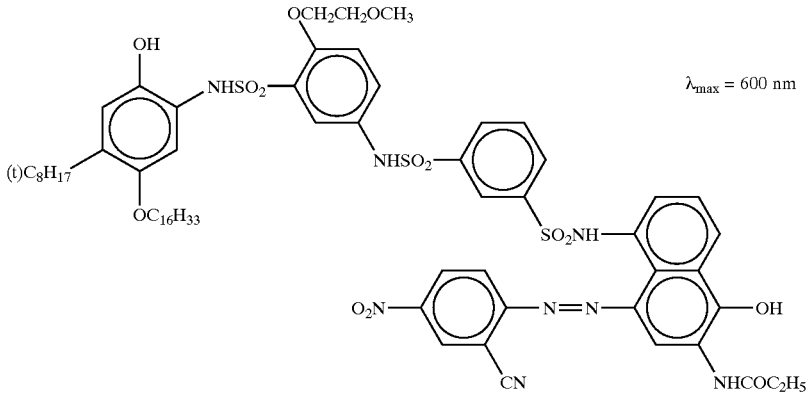
Dye (a)
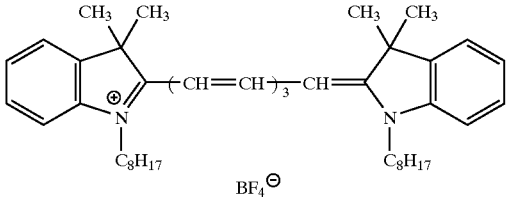
Magenta dye-providing compound ①
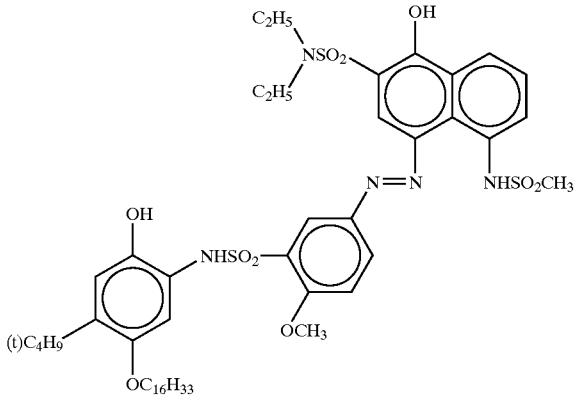

-continued
Yellow dye-providing compound ①
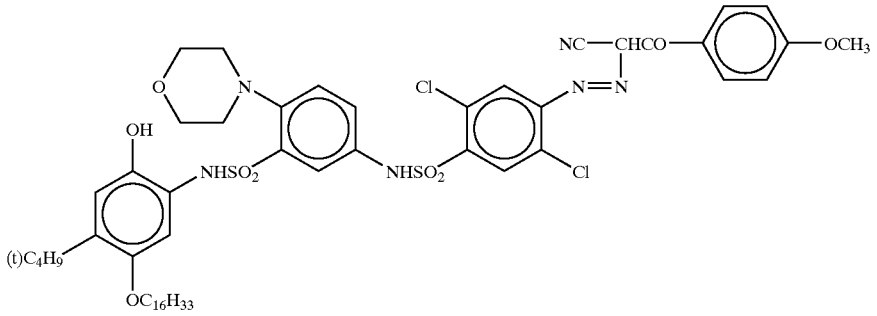
Reducing agent ①
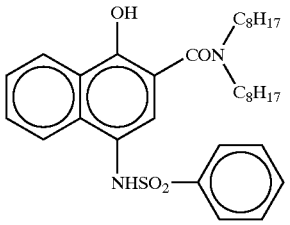
Antifoggant ③
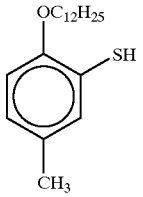
Antigoggant ④
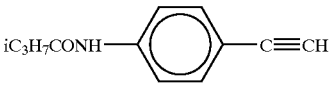
Surfactant ①
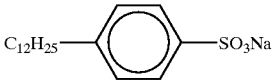
Development accelerator ①
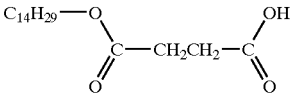
Antifoggant ⑤
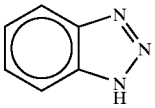
High-boiling solvent ①
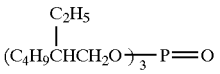
High-boiling solvent ②
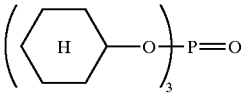
Antiseptic ③
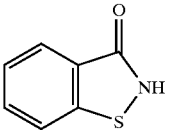

-continued
Reducing agent ②
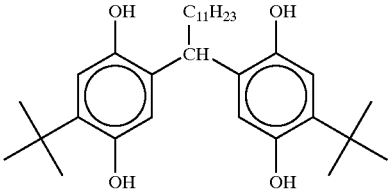
Antiseptic ④
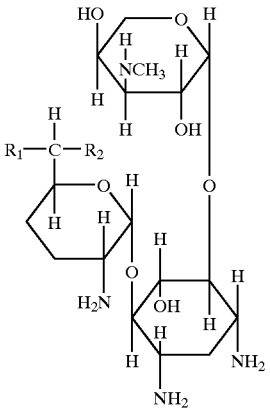
| | $R_1$ | $R_2$ |
|---|---|---|
| $C_1$ | $H_3C$— | —$NHCH_3$ |
| $C_2$ | $H_3C$— | —$NH_2$ |
| $C_{10}$ | H— | —$NH_2$ |
| $C_{20}$ | H— | —$NHCH_3$ |
Surfactant ②
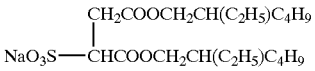
Surfactant ③
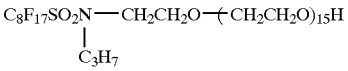
Water-soluble polymer ①
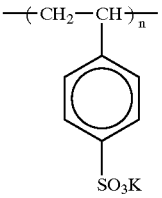
limiting-viscosity
[η] = 1.6
(0.1N NaCl, 30° C.)
Molecular weight ≈ 1,000,000
Water-soluble polymer ②
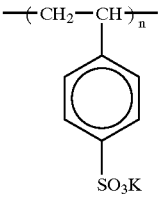
limiting-viscosity
[η] = 0.8
(0.1N NaCl, 30° C.)
Molecular weight ≈ 400,000

-continued
Sensitizing dye ③
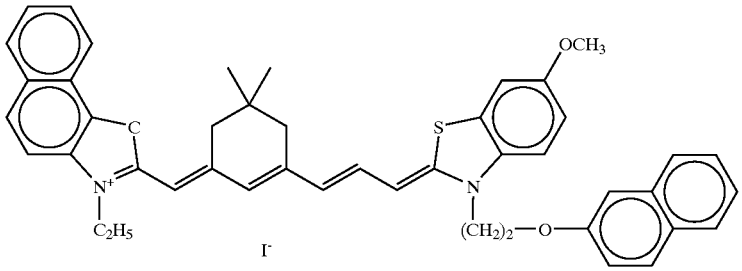
Hardener ①
$CH_2{=}CHSO_2CH_2SO_2CH{=}CH_2$
Surfactant ④
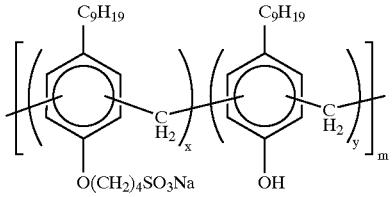
x:y = 4:6 m ≈ 6.8
High-boiling solvent ④
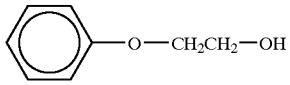
High-boiling organic solvent ⑤
$C_{24}H_{44}Cl_6$
(EMPARA 40 (trade name:
manufactured by Ajinomoto K. K.))
Magenta dye-providing compound ②
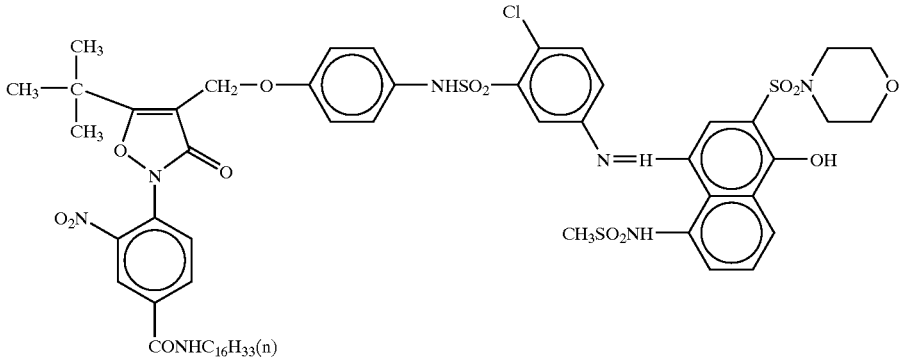
Polymer Latex a.
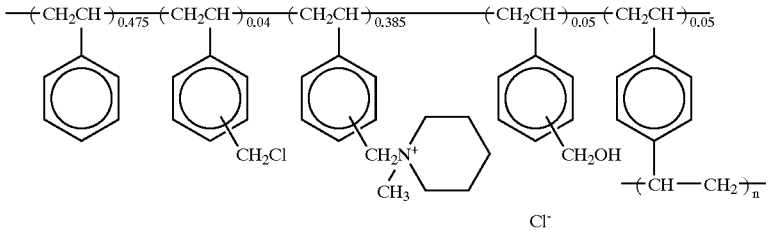

-continued

Surfactant ⑤

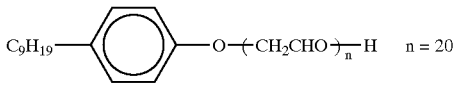

n = 20

Surfactant ⑥

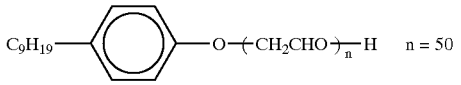

n = 50

Surfactant ⑦

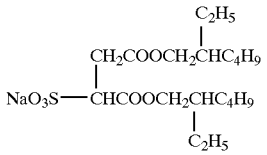

Samples 102 to 104 according to the present invention and Samples 105 to 108 for comparison were prepared in the same manner as the above heat-developable light-sensitive material Sample 101 according to the present invention, except that the additive materials in each of the seventh layer (outermost layer) and the sixth layer (adjacent layer) were changed, as shown in Table 24. Each of these Samples and the above Image-Receiving Material M101 were combined together respectively, and they were subjected to wedge exposure to light. Each of these combinations was then processed via heat development using a digital color printer Fujix Pictrography PG-4000 (trade name, manufactured by Fuji Photo Film Co., Ltd.), to observe the degree of occurrence of fogging.

On the other hand, in order to evaluate the state of coated surface, another set of the corresponding Samples were prepared in the same manner as in the above, except that only the amount to be coated in the seventh layer (outermost layer) was decreased to ⅙ in amount (while other structural layers were not changed in coated amount) when coating. The surface state of the thus-prepared Samples was evaluated with naked eyes. The evaluation of cissings was made by counting the number of cissings on the coated surface with an optical microscope. The case when the number of cissings was less than 11/mm$^2$ was rated as "○ (good)", and the case when the number of cissings was 11/mm$^2$ or more was rated as "X (poor)". The evaluation of coating property was made by observing, with naked eyes, both the coat-cut portions at edges (coating deficiency at both the right and left ends in the coating direction) and the degree of disorder of the coated parts. The case when the number of the coat-cut portions at edges was small and the degree of disorder of the coated parts was low was rated as "○", and the case when the number of the coat-cut portions at edges was large and the degree of disorder of the coated parts was high was rated as "X".

The obtained results are shown in Table 24.

TABLE 24

| | | This invention | | | | Examples for comparison | | | |
|---|---|---|---|---|---|---|---|---|---|
| | Sample No. | 101 | 102 | 103 | 104 | 105 (Control) | 106 | 107 | 108 |
| Seventh layer (Outermost layer) | Fluorine-containing nonionic surfactant ③ | Contained | Contained | None | None | None | Contained | Contained | Contained |
| | Fluorine-containing nonionic surfactant (1A-14) | None | None | Contained | None | None | None | None | None |
| | Fluorine-containing nonionic surfactant (1A-18) | None | None | None | Contained | None | None | None | None |
| | Fluorine-containing anionic surfactant (2)* | None | None | None | None | Contained | None | None | None |
| | Polyvalent metal salt ($CaNO_3$) | Contained ($4 \times 10^{-5}$ mol/m$^2$) | None | Contained ($4 \times 10^{-5}$ mol/m$^2$) | Contained ($4 \times 10^{-5}$ mol/m$^2$) | Contained ($4 \times 10^{-5}$ mol/m$^2$) | Contained ($1 \times 10^{-5}$ mol/m$^2$) | Contained ($4 \times 10^{-5}$ mol/m$^2$) | None |
| | Polyvalent metal salt ($Ba(OH)_2$) | None | Contained ($4 \times 10^{-5}$ mol/m$^2$) | None | None | None | None | None | None |
| | Anionic surfactant ② | Contained | Contained | Contained | Contained | Contained | Contained | None | Contained |
| | Anionic surfactant ① | Contained | Contained | Contained | Contained | Contained | Contained | None | Contained |

TABLE 24-continued

| | | This invention | | | | Example for comparison | | | |
|---|---|---|---|---|---|---|---|---|---|
| Sample No. | | 101 | 102 | 103 | 104 | 105 (Control) | 106 | 107 | 108 |
| Sixth layer (Adjacent layer) | Polyvalent metal salt ($CaNO_3$) | Contained | None | Contained | Contained | Contained | Contained | Contained | Contained |
| | Polyvalent metal salt ($Ba(OH)_2$) | None | Contained ($8 \times 10^{-5}$ mol/$m^2$) | None | None | None | None | None | None |
| | Anionic surfactant ① | Contained | Contained | Contained | Contained | Contained | Contained | Contained | Contained |
| | Anionic surfactant ② | Contained | Contained | Contained | Contained | Contained | Contained | Contained | Contained |
| State of coated surface | Cissing | ○ | ○ | ○ | ○ | x | x | x | ○ |
| | Coating property | ○ | ○ | ○ | ○ | ○ | x | x | x |
| Antistatic property | | ○ | ○ | ○ | ○ | ○ | ○ | ○ | ○ |
| Occurrence of fog | | ○ | ○ | ○ | ○ | ○ | ○ | x | ○ |

Note:
*(2) represents the anionic surfactant (2) in the Sixth layer of the Image-Receiving Material M101.

The following facts can be understood from the results as shown in Table 24.

Specifically, the Samples 101 to 104 according to the present invention each were good (evaluation:○) in view of state of coated surface, antistatic property, and suppression of fogging, even if the type of fluorine-containing nonionic surfactant in the outermost layer was altered, or even if the type of polyvalent metal salt in the outermost layer or the layer adjacent to the outermost layer was altered. Incidentally, the number of cissing in each of the Samples 101 to 104 according to the present invention was 0/$mm^2$ (not occurred at all).

On the contrary, with respect to the Comparative sample 105 (control), it is found that cissing deficiency was caused, because not a nonionic surfactant but an anionic surfactant was used in the outermost layer although the anionic surfactant was a fluorine-containing type. Also, regarding the Comparative sample 106, it is found that the state of coated surface (cissings and coating property) was poor, because the amount of the polyvalent metal salt to be used in the outermost layer was too small. With respect to the Comparative sample 107, the state of coated surface (cissings and coating property) was poor, as well as the Reducing agent ② (antifoggant) could not be emulsified, thereby causing fog (evaluation: X), because no anionic surfactant was used in the outermost layer. Regarding the Comparative sample 108, it is found that the coating property was poor, because no polyvalent metal salt was used in the outermost layer.

In addition, after applied and dried, each sample was subjected to an antistatic property test according to a usual method. As a result, no discharge from each of the samples was observed, showing that each sample was good in antistatic property (evaluation:○).

Having described our invention as related to the present embodiments, it is our intention that the invention not be limited by any of the details of the description, unless otherwise specified, but rather be construed broadly within its spirit and scope as set out in the accompanying claims.

What we claim is:

1. An information recording material having a support and comprising:

(A) an outermost layer on said support on the side of an information recording layer, said outermost layer comprising a fluorine containing nonionic surfactant, $1.5\times 10^{-5}$ mol/$m^2$ or more of a polyvalent metal salt, and an anionic surfactant capable of forming a sparingly soluble salt in an aqueous solution with the polyvalent metal, and (B) an underlayer adjacent to the outermost layer which comprises a polyvalent metal salt and an anionic surfactant capable of forming a sparingly soluble salt with the polyvalent metal.

2. The information recording material according to claim 1, wherein the fluorine-containing nonionic surfactant is selected from the group consisting of:

IA-1

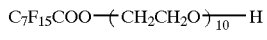

IA-2

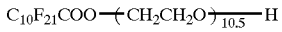

IA-3

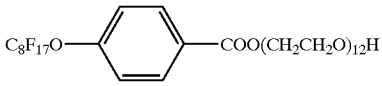

IA-4

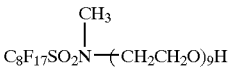

IA-5

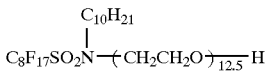

IA-6

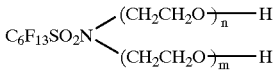

n + m = 11.5

IA-7

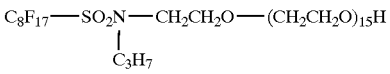

IA-8

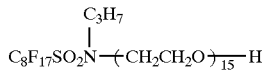

IA-9

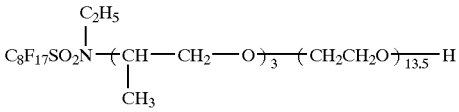

IA-10

-continued

IA-11

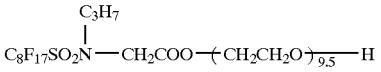

IA-12

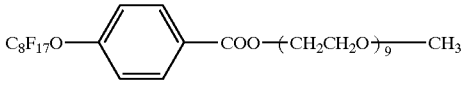

IA-13

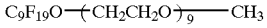

IA-14

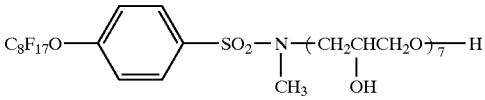

IA-15

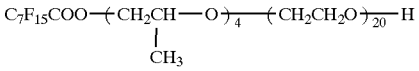

IA-16

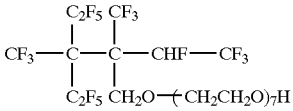

IA-17

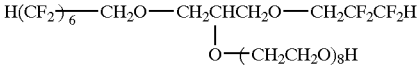

IA-18

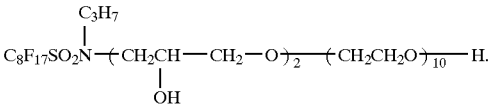

3. The information recording material according to claim 1, wherein the polyvalent metal salt is calcium nitrate, magnesium nitrate, barium sulfate or zinc stearate.

4. The information recording material according to claim 1, wherein the anionic surfactant is represented by one of the following formulas (1) to (9):

(1)

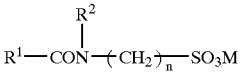

(2)

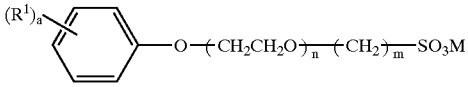

(3)

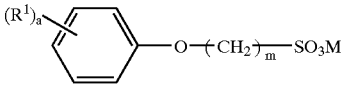

(4)

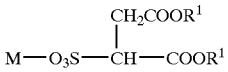

(5)

(6)

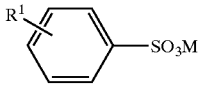

(7)

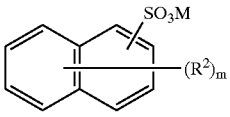

-continued (8)

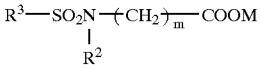

(9)

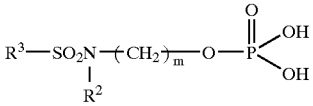

wherein, in formula (1), $R^1$ represents a saturated or unsaturated hydrocarbon group having 3 to 20 carbon atoms or a fluorine-substituted group thereof; $R^2$ represents a hydrogen atom or a hydrocarbon group having 1 to 3 carbon atoms; n is an integer from 1 to 20; and M represents a monovalent alkali metal;

in formulas (2) and (3), $R^1$, M and n have the same meanings as defined in formula (1); a is 0, 1 or 2, and m is an integer from 1 to 6;

in formulas (4), (5) and (6), $R^1$ and M have the same meanings as defined in formula (1);

in formula (7), $R^2$ and M have the same meanings as defined in formula (1), and m has the same meaning as defined in formula (2);

in formulas (8) and (9), $R^3$ represents a saturated or unsaturated hydrocarbon group which has 3 to 22 carbon atoms in which the hydrogen portion is fluorinated; $R^2$ and M have the same meanings as defined in formula (1), and m has the same meaning as defined in formula (2).

5. The information recording material according to claim 1, wherein the polyvalent metal salt in the underlayer is calcium nitrate, magnesium nitrate, barium sulfate or zinc stearate.

6. The information recording material according to claim 1, wherein the anionic surfactant in the underlayer is represented by one of the following formulas (1) to (9):

(1)

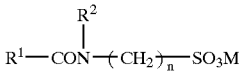

(2)

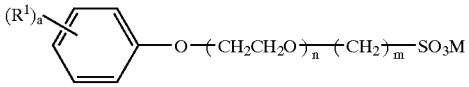

(3)

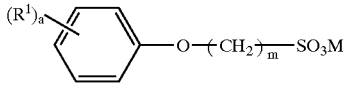

(4)

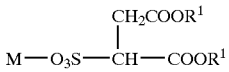

(5)

(6)

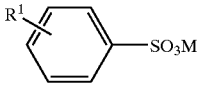

(7)

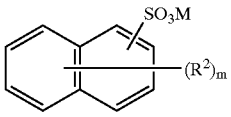

-continued (8)

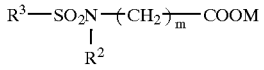

(9)

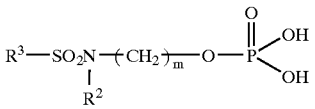

wherein, in formula (1), $R^1$ represents a saturated or unsaturated hydrocarbon group having 3 to 20 carbon atoms or a fluorine-substituted group thereof; $R^2$ represents a hydrogen atom or a hydrocarbon group having 1 to 3 carbon atoms; n is an integer from 1 to 20; and M represents a monovalent alkali metal;

in formulas (2) and (3), $R^1$, M and n have the same meanings as defined in formula (1); a is 0, 1 or 2, and m is an integer from 1 to 6;

in formulas (4), (5) and (6), $R^1$ and M have the same meanings as defined in formula (1);

in formula (7), $R^2$ and M have the same meanings as defined in formula (1), and m has the same meaning as defined in formula (2); in formulas (8) and (9), $R^3$ represents a saturated or unsaturated hydrocarbon group which has 3 to 22 carbon atoms in which the hydrogen portion is fluorinated, $R^2$ and N have the same meanings as defined in formula; (1), and m has the same meaning as defined in formula (2).

7. The information recording material according to claim 1, wherein the polyvalent metal salts are the same ones as in the outermost layer and the underlayer adjacent thereto, and the anionic surfactants are the same ones as in the outermost layer and the underlayer adjacent thereto.

8. The information recording material according to claim 1, wherein the information recording layer is a light-sensitive silver halide emulsion layer.

9. A heat-developable color photographic light-sensitive material having a support comprising:

(A) a surface layer on said support on the side of a light-sensitive silver halide emulsion layer, said surface layer comprising a fluorine-containing nonionic surfactant, $1.5\times10^{-5}$ mol/m$^2$ or more of a polyvalent metal salt, and an anionic surfactant capable of forming a sparingly soluble salt in an aqueous solution with the polyvalent metal, and (B) an underlayer adjacent to the outermost layer which comprises a polyvalent metal salt and an anionic surfactant capable of forming a sparingly soluble salt with the polyvalent metal.

10. The heat-developable color photographic light-sensitive material according to claim 9, wherein the fluorine-containing nonionic surfactant is selected from the group consisting of:

IA-1

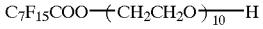

IA-2

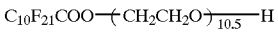

IA-3

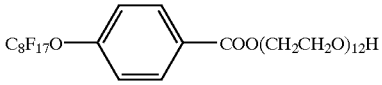

-continued

IA-4

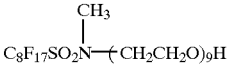

IA-5

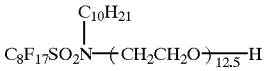

IA-6

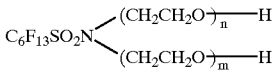

n + m = 11.5

IA-7

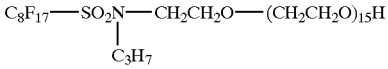

IA-8

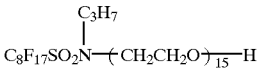

IA-9

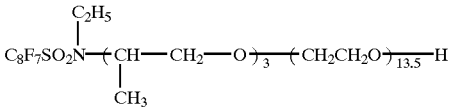

IA-10

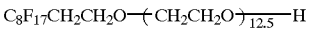

IA-11

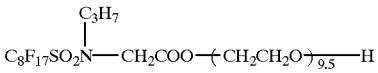

IA-12

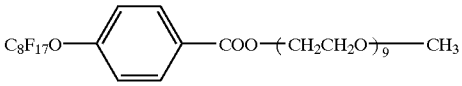

IA-13

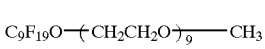

IA-14

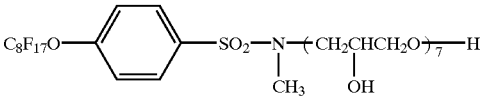

IA-15

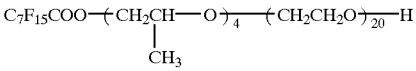

IA-16

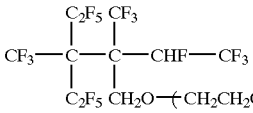

IA-17

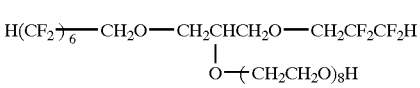

IA-18

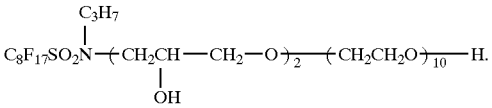

11. The heat-developable color photographic light-sensitive material according to claim 9, wherein the polyvalent metal salt is calcium nitrate, magnesium nitrate, barium sulfate or zinc stearate.

12. The heat-developable color photographic light-sensitive material according to claim 9, wherein the anionic surfactant is represented by one of the following formulas (1) to (9):

(1)

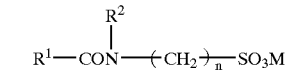

(2)

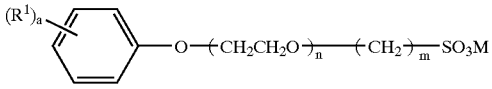

(3)

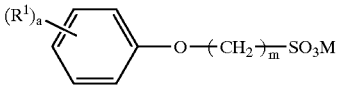

(4)

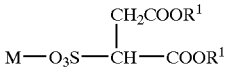

(5)

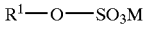

(6)

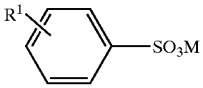

(7)

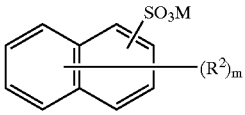

(8)

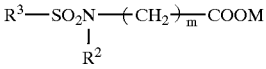

(9)

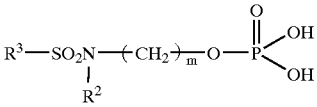

wherein, in formula (1), $R^1$ represents a saturated or unsaturated hydrocarbon group having 3 to 20 carbon atoms or a fluorine-substituted group thereof; $R^2$ represents a hydrogen atom or a hydrocarbon group having 1 to 3 carbon atoms; n is an integer from 1 to 20; and M represents a monovalent alkali metal;

in formulas (2) and (3), $R^1$, M and n have the same meanings as defined in formula (1); a is 0, 1 or 2, and m is an integer from 1 to 6;

in formulas (4), (5) and (6), $R^1$ and M have the same meanings as defined in formula (1);

in formula (7), $R^2$ and M have the same meanings as defined in formula (1), and m has the same meaning as defined in formula (2);

in formulas (8) and (9), $R^3$ represents a saturated or unsaturated hydrocarbon group which has 3 to 22 carbon atoms in which the hydrogen portion is fluorinated; $R^2$ and M have the same meanings as defined in formula (1), and m has the same meaning as defined in formula (2).

13. The heat-developable color photographic light-sensitive material according to claim 9, wherein the polyvalent metal salt in the underlayer is calcium nitrate, magnesium nitrate, barium sulfate or zinc stearate.

14. The heat-developable color photographic light-sensitive material according to claim 9, wherein the anionic surfactant in the underlayer is represented by one of the following formulas (1) to (9):

(1)

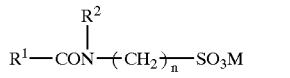

(2)

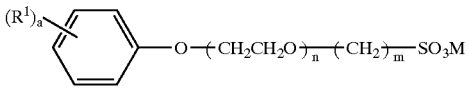

(3)

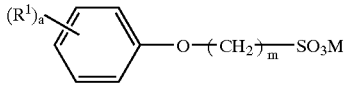

(4)

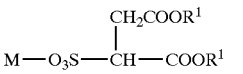

(5)

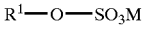

(6)

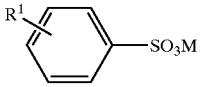

(7)

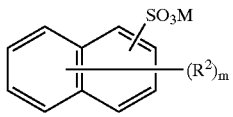

(8)

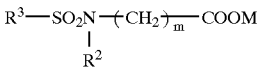

(9)

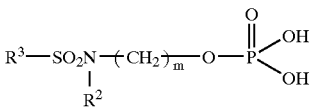

wherein, in formula (1), $R^1$ represents a saturated or unsaturated hydrocarbon group having 3 to 20 carbon atoms or a fluorine-substituted group thereof; $R^2$ represents a hydrogen atom or a hydrocarbon group having 1 to 3 carbon atoms; n is an integer from 1 to 20; and M represents a monovalent alkali metal;

in formulas (2) and (3), $R^1$, M and n have the same meanings as defined in formula (1); a is 0, 1 or 2, and m is an integer from 1 to 6;

in formulas (4), (5) and (6), $R^1$ and M have the same meanings as defined in formula (1);

in formula (7), $R^2$ and M have the same meanings as defined in formula (1), and m has the same meaning as defined in formula (2);

in formulas (8) and (9), $R^3$ represents a saturated or unsaturated hydrocarbon group which has 3 to 22 carbon atoms in which the hydrogen portion is fluorinated; $R^2$ and M have the same meanings as defined in formula (1), and m has the same meaning as defined in formula (2).

15. The heat-developable color photographic light-sensitive material according to claim 9, wherein the polyvalent metal salts are the same ones as in the outermost layer and the underlayer adjacent thereto, and the anionic surfactants are the same ones as in the outermost layer and the underlayer adjacent thereto.

* * * * *